US005496795A

United States Patent [19]

Das

[11] Patent Number: 5,496,795

[45] Date of Patent: Mar. 5, 1996

[54] HIGH TC SUPERCONDUCTING MONOLITHIC FERROELECTRIC JUNABLE B AND PASS FILTER

[76] Inventor: Satyendranath Das, P.O. Box 574, Mt View, Calif. 94042-0574

[21] Appl. No.: 291,702

[22] Filed: Aug. 16, 1994

[51] Int. Cl.[6] ..... H01P 1/203; H01B 12/02

[52] U.S. Cl. ..... 505/210; 505/700; 505/701; 505/866; 333/205; 333/99.005

[58] Field of Search ..... 333/205, 204, 333/995, 219; 505/210, 700, 701, 866

[56] References Cited

U.S. PATENT DOCUMENTS

| | | | |
|---|---|---|---|
| 5,164,358 | 11/1992 | Buck et al. | 505/210 |
| 5,258,626 | 11/1993 | Suzuki et al. | 505/210 X |
| 5,404,119 | 4/1995 | Kim | 333/204 |

FOREIGN PATENT DOCUMENTS

| | | | |
|---|---|---|---|
| 4115602 | 4/1992 | Japan | 333/204 |

OTHER PUBLICATIONS

Talisa, S. H., et al; "Low and High Temperature Superconducting Microwave Filters"; *IEEE Trans on Microwave Theory and Techniques;* vol. MTT–39; No. 9; Sep. 1991; pp. 1448–1454.

Jackson, C. M., et al., "Novel Monolithic Phase Shifter Combining Feroelectrics and High Temperature Superconductors"; *Microwave and Optical Technology Letters;* vol. 5, No. 14; 20 Dec. 1992; pp. 722–726.

*Primary Examiner*—Benny T. Lee

[57] ABSTRACT

The design of a high Tc superconducting band pass tunable ferroelectric filter (TFF) is presented. The band pass TFF consists of an edge coupled filter on a ferroelectric substrate. Each input and output microstrip line is a quarter wavelength long. Each intermediate microstrip line is a half wavelength long with the first quarter wavelength being coupled to the preceding microstrip line and the remaining quarter wavelength being coupled to the succeeding microstrip line. Each microstrip line is connected, through an LC filter, to a common bias voltage source. Application of a bias voltage changes the frequency of operation of the filter. For matching the impedances of the input and output of the filter to the impedances of an input and output circuit respectively, matching ferroelectric quarter wavelength transformers are provided.

18 Claims, 2 Drawing Sheets

HIGH TC SUPERCONDUCTING MONOLITHIC FERROELECTRIC JUNABLE B AND PASS FILTER

FIELD OF INVENTION

The present invention relates to filters of electromagnetic waves.

DESCRIPTION OF THE STATE OF THE ART

In many fields of electronics, it is often necessary to filter or pass signals dependent on their frequencies. Commercial filters are available.

Microstrip filters have been discussed. B. J. Minnis, "Printed circuit line filters for bandwidths up to and greater than an octave," IEEE Trans. MTT-29, pp. 215–222, 1981.

Das discussed operation, of microwave ferroelectric devices, slightly above the Curie temperature, to avoid hysteresis and showed the permittivity of a ferroelectric material to be maximum at the Curie temperature and the permittivity to reduce in magnitude as one moves away from the Curie temperature. S. Das, "Quality of a Ferroelectric Matreial," IEEE Trans. MTT-12, pp. 440–445, July 1964.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, and as such the device is small in size. The ferroelectrics are operated in the paraelectric phase i.e. slightly above the Curie temperature. The ferroelectric filter can be made of films, and is made of monolithic microwave integrated circuits (MMIC) technology. Inherently they have a broad bandwidth. They have no low frequency limitation as in the case of ferrite devices. The high frequency operation is governed by the relaxation frequency, such as 95 GHz for strontium titanate, of the ferroelectric material. The loss of a ferroelectric tunable filter is low with ferroelectric materials with a low loss tangent. A number of ferroelectric materials are not subject to burnout. Ferroelectric devices are reciprocal.

Depending on trade-off studies in individual cases, the best type of tunable filter can be selected.

SUMMARY OF THE INVENTION

The purpose of this invention is to provide filters with losses significantly lower than the room temperature filters of comparable design.

Another object of this invention is to design a microstrip line monolithic technology ferroelectric tunable filter. It is made of edge coupled microstrip lines on a ferroelectric material, solid or film type, substrate. Same levels of bias voltage applied to the different sections of the edge coupled filter, the effective electrical length of the microstrip line sections change the tuning of the filter to a different frequency. The microstrip line edge coupled filter on a ferroelectric film is a MMIC. The conductor is made of a single crystal high Tc superconductor including YBCO, TBCCO.

One purpose of this invention is to lower the losses of the filters below those of the conventional room temperature filters of comparable design. Another object of this design is to design filters to handle power levels of at least 0.5 Megawatt. G. Shen, C. Wilker, P. Pang and W. L. Holstein, "High Tc Superconducting-sapphire Microwave resonator with Extremely High Q-Values Up To 90K," IEEE MTT-S Digest, pp. 193–196, 1992.

With these and other objectives in view, as will hereinafter be more particularly pointed out in detail in the the appended claims, reference is now made to the following description taken in connection with the accompanying diagrams.

DETAILED DESCRIPTION OF THE PREFERRED EMBODIMENTS

Figure 1:
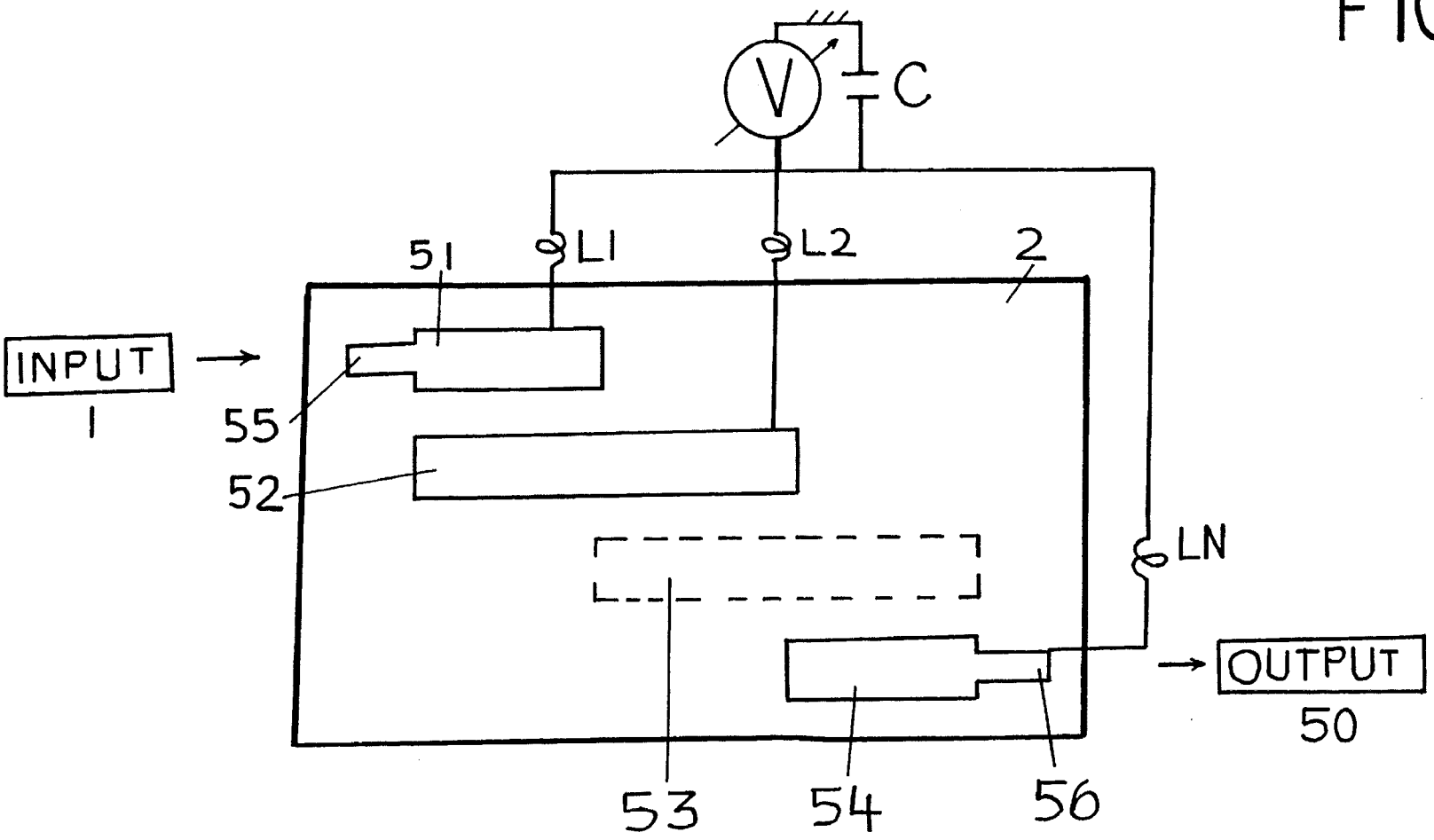
FIG. 1: A first microstrip line tunable band pass filter.

Now referring to the drawings, in FIG. 1 is depicted a first embodiment of the present invention. It consists of an RF input 1 and an output 50.

All ferroelectric materials and ferroelectric liquid crystals (FLC) are included in this invention. One example is $Sr_{1-x}Pb_xTiO_3$. The Curie temperature of $SrTiO_3$ is ~37 degrees K. By adding a small amount of $PbTiO_3$ the Curie temperature is increased to slightly below the high superconducting Tc i.e. 70–98 degrees K. Another example is $KTa_{1-x}Nb_xO_3$. A third example is $Sr_{1-x}Ba_xTiO_3$. The major component of the filter loss is the dielectric loss. The loss tangents of $KTaNbO_3$ and $SrTiO_3$ are low. The magnitudes of the permittivity and the loss tangent can be reduced by making a composition of polythene powder and a powdered ferroelectric material having a high value of permittivity.

In FIG. 1 is depicted an embodiment of this invention. This is an edge coupled ferroelectric monolithic tunable band pass filter. It contains a microstrip line 51 on a ferroelectric material in one embodiment and on film 2 in another embodiment and being a quarter wavelength long at an operating frequency of the filter. A second microstrip line 52 on the same ferroelectric material in one embodiment and on film 2 in another embodiment is a half wavelength long at an operating frequency of the monolithic filter, one quarter wavelength thereof being edge coupled to the previous microstrip line 51 and the other quarter wavelength thereof being edge coupled to the following microstrip line 53. There are third, fourth . . . (n-1)th microstrip lines on the same ferroelectric material in one embodiment and on film 2 in another embodiment half wavelength long at an operating frequency of the monolithic filter and with one quarter wavelength thereof being edge coupled to the previous microstrip line and the other quarter wavelength line thereof being coupled to the following microstrip line. The output microstrip line 54 is a quarter wavelength long at an operating frequency of the monolithic filter and is coupled to the previous microstrip line. The microstrip lines 51, 52, . . . 54 are connected to bias inductances L1, L2, . . . LN respectively. The inductances provide high impedance at the operating frequency of the monolithic filter. The capacitance C provides a low impedance to any remaining RF energy. All the microstrip lines are on a ferroelectric material in one embodiment and film in another embodiment. When a bias voltage V is applied to the microstrip lines on the ferroelectric material in one embodiment and film in another embodiment of the filter, the permittivity of the ferroelectric material and the electrical length of the microstrip lines change, consequently changing the operating frequency of the filter. The impedance of the microstrip lines also change with the application of a bias voltage. To provide matching to the input circuit, when a bias voltage V is applied to the filter, a quarter wavelength transformer 55 of the same ferroelectric material in one embodiment and film in another embodiment, as the ferroelectric material and film of the microstrip line 51, is connected to the microstrip line 51. A ferroelectric quarter wavelength microstrip line 56 is connected to the output microstrip line 54 to match the impedance of the output microstrip line 54 to the impedance of the output circuit. The conductors in one embodiment of the microstrip lines are room temperature conductors and a film in another embodiment of a single crystal high Tc superconductor. The bottom side of the monolithic filter is deposited with a film of a conductor in one embodiment and a film of single crystal high Tc superconductor in another embodiment and respectively connected to the ground.

Figure 2:
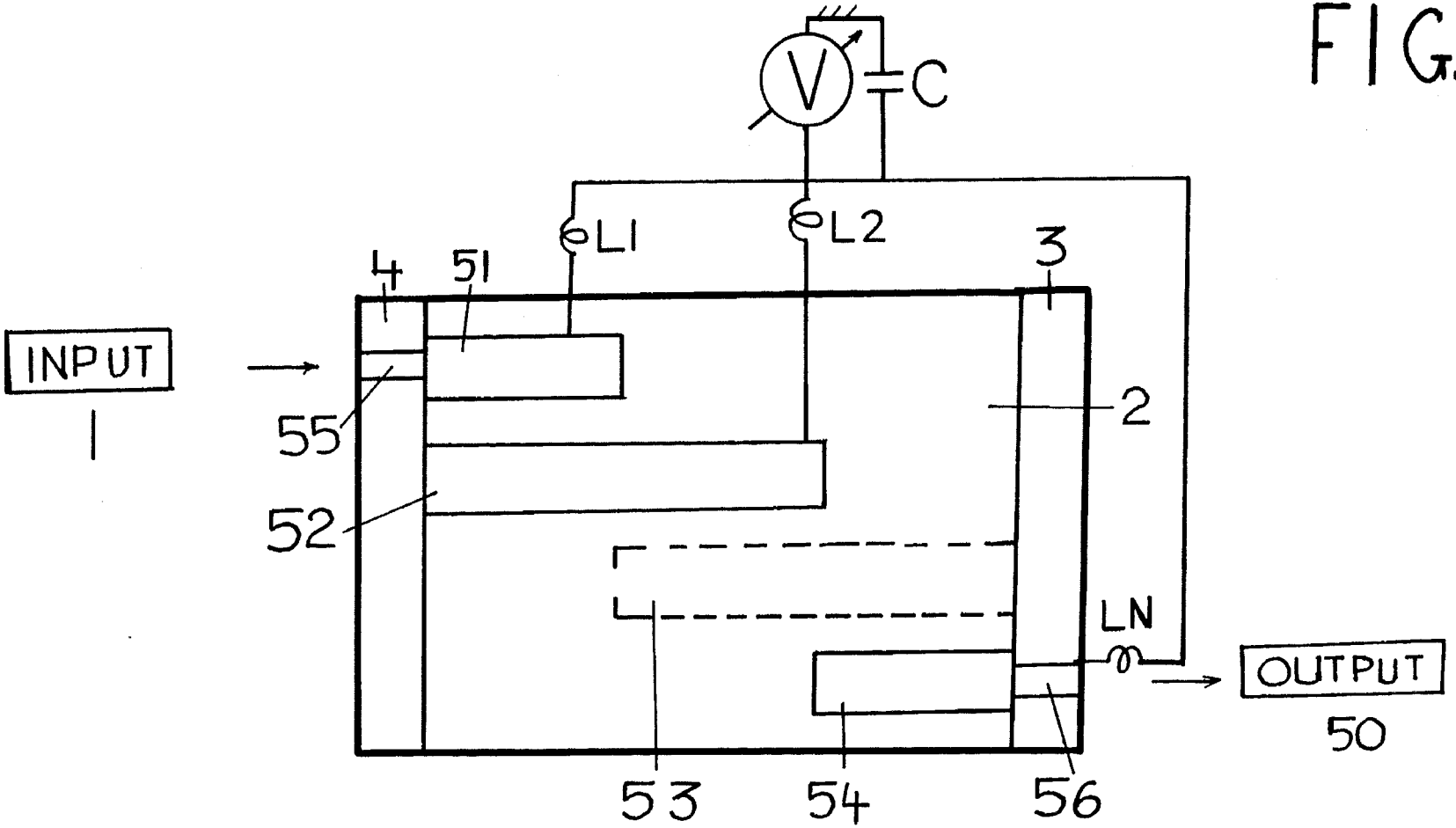
FIG. 2: A second microstrip line tunable band pass filter.

In FIG. 2 is depicted an embodiment of this invention. This is an edge coupled ferroelectric monolithic tunable band pass filter. It contains a microstrip line 51 on a ferroelectric material in one embodiment and on film 2 in another embodiment and being a quarter wavelength long at an operating frequency of the filter. A second microstrip line 52 on the same ferroelectric material in one embodiment and on film 2 in another embodiment is a half wavelength long at an operating frequency of the monolithic filter, one quarter wavelength thereof being edge coupled to the previous microstrip line 51 and the other quarter wavelength thereof being edge coupled to the following microstrip line 53. There are third, fourth . . . (n-1)th microstrip lines on the same ferroelectric material in one embodiment and on film 2 in another embodiment. Each of them is half wavelength long at an operating frequency of the monolithic filter and with one quarter wavelength thereof being edge coupled to the previous microstrip thereof and the other quarter wavelength line being coupled to the following microstrip line. The output microstrip line 54 is a quarter wavelength long at an operating frequency of the monolithic filter and is coupled to the previous microstrip line. The microstrip lines 51, 52, . . . 54 are connected to bias inductances L1, L2, . . . LN respectively. The inductances provide high impedance at the operating frequency of the monolithic filter. The capacitance C provides a low impedance to any remaining RF energy. All the microstrip lines are on a ferroelectric material and film. When a bias voltage V is applied to the microstrip lines on the ferroelectric material and film of the filter, the permittivity of the ferroelectric material and the electrical length of the microstrip lines change, consequently changing the operating frequency of the filter. The impedance of the microstrip lines also change with the application of a bias voltage. To provide matching to the input circuit, when a bias voltage V is applied to the filter, a quarter wavelength transformer 55 is connected to the microstrip line 51. A ferroelectric quarter wavelength microstrip line 56 is connected to the output microstrip line 54 to match the impedance of the output microstrip line 54 to the impedance of the output circuit. In FIG. 2, the ferroelectric material 4.3 of the input and output quarter wavelength transformers is different from the ferroelectric material of the monolithic filter. The conductors in one embodiment of the microstrip lines are room temperature conductors and a film in another embodiment of a single crystal high Tc superconductor. The bottom side of the monolithic filter is deposited with a film of a conductor and a film of single crystal high Tc superconductor and connected to the ground.

It should be understood that the foregoing disclosure relates to only typical embodiments of the invention and that numerous modification or alternatives may be made, by those of ordinary skill, therein without departing from the spirit and the scope of the invention as set forth in the appended claims. Different operating frequencies, all ferroelectric materials, compositions of ferroelectric materials with powder polythene and other low permittivity materials, ferroelectric liquid crystals (FLC), and high Tc superconductors are contemplated in this invention.

What is claimed is:

1. A ferroelectric band pass tunable monolithic filter, having an electric field dependent permittivity, an input, an output, a tunable operating frequency and comprising:

a first microstrip line disposed on a ferroelectric material characterized by said permittivity, and being one quarter wave long at an operating frequency of the filter;

second, third, fourth . . . (n-1)th, nth microstrip lines;

said second microstrip line disposed on said ferroelectric material characterized by said permittivity, and being one half wavelength long, at an operating frequency of the filter, and said second microstrip line having a first one quarter wavelength portion being edge coupled to and separate from the first microstrip line and having a remaining second quarter wavelength being coupled to and separate from the following third microstrip line;

said third, fourth . . . (n-1)th microstrip lines respectively disposed on said ferroelectric material, characterized by said permittivity, each one of said third, fourth . . . (n-1)th microstrip lines respectively being one half wavelength long, at the operating frequency of the filter, having a first one quarter wavelength portion thereof being edge coupled to and separate from previous (n-2)th one of the microstrip lines, and having a remaining second quarter wavelength portion thereof being coupled to and being separate from a succeeding one of the microstrip lines;

said nth microstrip line disposed on said ferroelectric material, characterized by said permittivity, and being one quarter wave long, at an operating frequency of the filter, said nth microstrip line being coupled to and being separate from the (n-1)th microstrip line;

an input ferroelectric transformer, having a bias voltage dependent impedance, being quarter wavelength long at an operating frequency of the filter, and comprised of a ferroelectric material which is the same as a ferroelectric material of the filter, said input ferroelectric transformer being connected to and being a part of the first microstrip line for matching an impedance of an input circuit of the filter to a bias voltage dependent impedance of the first microstrip line and providing a good impedance match over the operating bias voltages;

a first transmission means for coupling energy into said input ferroelectric transformer at the input:

an output ferroelectric transformer, having a bias voltage dependent impedance, being quarter wavelength long at an operating frequency of the filter, and comprised of a ferroelectric material which is the same as a ferroelectric material of the filter, said output ferroelectric transformer being connected to and being a part of the nth microstrip line of the filter for matching a bias voltage dependent impedance of the nth microstrip line of the filter to an impedance of an output circuit of the filter providing a good impedance match over the operating bias voltages;

a second transmission means for coupling energy from the output ferroelectric transformer at the output;

all microstrip lines and ferroelectric transformers being operated at the same tunable frequency;

voltage means for applying a bias voltage to all said microstrip lines;

said microstrip lines being comprised of a film of a single crystal high Tc superconductor; and means for operating said band pass tunable filter at a high Tc superconducting temperature slightly above the Curie temperature associated with the ferroelectric film to avoid hysteresis and to provide a maximum change of permittivity of the ferroelectric material of the filter.

2. The ferroelectric band pass tunable monolithic high Tc superconducting filter, of claim 1 wherein said film of a single crystal high Tc superconductor being comprised of YBCO and said ferroelectric material being comprised of a single crystal $Sr_{1-x}Pb_xTiO_3$.

3. The ferroelectric band pass tunable monolithic high Tc superconducting filter, of claim 1 wherein said ferroelectric materials being comprised of ferroelectric liquid crystals (FLCs).

4. A ferroelectric band pass tunable monolithic filter, having an electric field dependent permittivity, an input, an output, a tunable operating frequency and comprising:

a first microstrip line disposed on a ferroelectric film, characterized by said permittivity, and being one quarter wave long at an operating frequency of the filter;

second, third, fourth . . . (n-1)th, nth microstrip lines;

said second microstrip line disposed on said ferroelectric film, characterized by said permittivity,and being one half wavelength long, at an operating frequency of the filter, and said second microstrip line having a first one quarter wavelength portion being edge coupled to and separate from the first microstrip line and having a remaining second quarter wavelength being coupled to and separate from the following the third microstrip line;

said third, fourth . . . (n-1)th microstrip lines respectively disposed on said ferroelectric film, characterized by said permittivity, each one of said third, fourth . . . (n-1)th microstrip lines respectively being one half wavelength long, at the operating frequency of the filter, having a first one quarter wavelength portion thereof being edge coupled to and separate from previous (n-2)th one of the microstrip lines, and having a remaining second quarter wavelength portion thereof being coupled to and being separate from a succeeding one of the microstrip lines;

said nth microstrip line disposed on said ferroelectric film, characterized by said permittivity, and being one quarter wave long, at an operating frequency of the filter, said nth microstrip line being coupled to and being separate from the (n-1)th microstrip line;

an input ferroelectric transformer, having a bias voltage dependent impedance, being quarter wavelength long at an operating frequency of the filter, and comprised of a ferroelectric film different from said ferroelectric film of the filter, said input ferroelectric transformer being connected to and being a part of the first microstrip line for matching an impedance of an input circuit of the filter to a bias voltage dependent impedance of the first microstrip line and providing a good impedance match over the operating bias voltages;

a first transmission means for coupling energy into the said input ferroelectric transformer at the input;

an output ferroelectric transformer, having a bias voltage dependent impedance, being quarter wavelength long at an operating frequency of the filter, and comprised of a ferroelectric film different from a ferroelectric film of the filter, said output ferroelectric transformer being connected to and being a part of the nth microstrip line of the filter for matching a bias voltage dependent impedance of the nth microstrip line of the filter to an impedance Of an output circuit of the filter and providing a good impedance match over the operating bias voltages;

a second transmission means for coupling energy out of the output ferroelectric transformer at the output;

all microstrip lines and ferroelectric transformers being operated at the same tunable frequency;

voltage means for applying a bias voltage to all said microstrip lines;

said microstrip lines being comprised of a film of a single crystal high Tc superconductor; and means for operating said band pass tunable filter at a high Tc superconducting temperature slightly above the Curie temperature associated with the ferroelectric film to avoid hysteresis and to provide a maximum change of permittivity of said ferroelectric film of the filter.

5. The ferroelectric band pass tunable monolithic high Tc superconducting filter, of claim 4 wherein said film of a single crystal high Tc superconductor being comprised of YBCO and said ferroelectric film of said first . . . nth microstrip lines, being comprised of a single crystal $KTa_{1-x}Nb_xO_3$.

6. The ferroelectric band pass tunable monolithic high Tc superconducting filter, of claim 5 wherein said input and output quarter wave transformers being respect comprised of a ferroelectric material different from a single crystal $KTa_{1-x}Nb_xO_3$.

7. The ferroelectric band pass tunable monolithic high Tc superconducting filter, of claim 4 wherein said film of a single crystal high Tc superconductor being comprised of YBCO.

8. The ferroelectric band pass tunable monolithic high Tc superconducting filter, of claim 4 wherein said ferroelectric film, of said first . . . nth microstrip lines, is comprised of a single crystal $Sr_{1-x}Pb_xTiO_3$.

9. The ferroelectric band pass tunable monolithic high Tc superconducting filter, of claim 4 wherein said ferroelectric film, of said first . . . nth microstrip lines, being comprised of a single crystal $KTa_{1-x}Nb_xO_3$.

10. The ferroelectric band pass tunable monolithic high Tc superconducting filter, of claim 4 wherein said film of a single crystal high Tc superconductor being comprised of YBCO and said ferroelectric film of said first . . . nth microstrip lines, being comprised of a single crystal $Sr_{1-x}Pb_xTiO_3$.

11. The ferroelectric band pass tunable monolithic high Tc superconducting filter, of claim 4 wherein said tunable filter is a MMIC.

12. A ferroelectric band pass tunable monolithic high Tc superconducting filter, having an electric field dependent permittivity, an input, an output, a tunable operating frequency and comprising:

a first microstrip line disposed on a ferroelectric film, characterized by said permittivity, and being one quarter wave long at an operating frequency of the filter;

second, third, fourth . . . (n-1)th, nth microstrip lines;

said second microstrip line disposed on said ferroelectric film, characterized by said permittivity, and being one half wavelength long, at an operating frequency of the filter, and said second microstrip line having a first one quarter wavelength portion being edge coupled to and separate from the first microstrip line and having a remaining second quarter wavelength being coupled to and separate from the following third microstrip line;

said third, fourth . . . (n-1)th microstrip lines respectively disposed on said ferroelectric film, characterized by said permittivity, each one of said third, fourth . . . (n-1)th microstrip lines respectively being one half wavelength long, at the operating frequency of the filter, having a first one quarter wavelength portion thereof being edge coupled to and separate from previous (n-2)th one of the microstrip lines, and having a remaining second quarter wavelength portion thereof being coupled to and being separate from a succeeding one of the microstrip lines;

said nth microstrip line disposed on said ferroelectric film, characterized by said permittivity, and being one quarter wave long, at an operating frequency of the filter, said nth microstrip line being coupled to and being separate from the (n-1)th microstrip line;

an input ferroelectric transformer, having a bias voltage dependent impedance, being quarter wavelength long at an operating frequency of the filter, and comprised of a ferroelectric film which is the same as a ferroelectric film of the filter, said input ferroelectric transformer being connected to and being a part of the first microstrip line for matching an impedance of an input circuit of the filter to a bias voltage dependent impedance of the first microstrip line and providing a good impedance match over the operating bias voltages;

a first transmission means for coupling energy into the input ferroelectric transformer at the input;

an output ferroelectric transformer, having a bias voltage dependent impedance, being quarter wavelength long at an operating frequency of the filter, and comprised of a ferroelectric film which is the same as a ferroelectric film of the filter, said output ferroelectric transformer being connected to and being a part of the nth microstrip line of the filter for matching a bias voltage dependent impedance of the nth microstrip line of the filter to an impedance of an output circuit of the filter and providing a good impedance match over the operating bias voltages;

a second transmission means for coupling energy out of the output ferroelectric transformer at the output;

all microstrip lines and ferroelectric transformers being operated at the same tunable frequency;

voltage means for applying a bias voltage to all said microstrip lines;

said microstrip lines being comprised of a film of a single crystal high Tc superconductor; and means for operating said band pass tunable filter at a high Tc superconducting temperature slightly above the Curie temperature associated with the ferroelectric film to avoid hysteresis and to provide a maximum change of permittivity for said ferroelectric film of the filter.

13. The ferroelectric band pass tunable monolithic high Tc superconducting filter, of claim 12 wherein said film of a single crystal high Tc superconductor being respect comprised of YBCO.

14. The ferroelectric band pass tunable monolithic high Tc superconducting filter, of claim 12 wherein said ferroelectric film is comprised of a single crystal $Sr_{1-x}Pb_xTiO_3$.

15. The ferroelectric band pass tunable monolithic high Tc superconducting filter, of claim 12 wherein said ferroelectric film being comprised of a single crystal $KTa_{1-x}Nb_xO_3$.

16. The ferroelectric band pass tunable monolithic high Tc superconducting filter, of claim 12 wherein said film of a single crystal high Tc superconductor being comprised of YBCO and said ferroelectric film being comprised of a single crystal $Sr_{1-x}Pb_xTiO_3$.

17. The ferroelectric band pass tunable monolithic high Tc superconducting filter, of claim 12 wherein said film of a single crystal high Tc superconductor being comprised of YBCO and said ferroelectric film being comprised of a single crystal $KTa_{1-x}Nb_xO_3$.

18. The ferroelectric band pass tunable monolithic high Tc superconducting filter of claim 12 wherein said film of a single crystal high Tc superconductor being comprised of TBCCO and said ferroelectric film being comprised of a single crystal $KTa_{1-x}Nb_xO_3$.

* * * * *

UNITED STATES PATENT AND TRADEMARK OFFICE

CERTIFICATE OF CORRECTION

PATENT NO. : 5,496,795

DATED : Mar. 5, 1996

INVENTOR(S) : Satyendranath Das

It is certified that error appears in the above-indentified patent and that said Letters Patent is hereby corrected as shown below:

On title page, item [54],

Title, 2nd line . "JUNABLE" is replaced by - - TUNABLE - -.

Column 1, Title, 2nd line. "JUNABLE" is replaced by - - TUNABLE - -.

In the Claims

Column 6, claim 6, line 3. "respect" is replaced by - - respectively - -.

Signed and Sealed this

Fourth Day of February, 1997

Bruce Lehman

*Attest:*

BRUCE LEHMAN

*Attesting Officer*

*Commissioner of Patents and Trademarks*